US005081952A

United States Patent [19]

Grassi et al.

[11] Patent Number: 5,081,952

[45] Date of Patent: Jan. 21, 1992

[54] PAINT FIXTURE FOR SUPPORTING ARTICLE DURING ELECTROSTATIC SPRAYING

[75] Inventors: John A. Grassi, Princeville; Samuel B. Stevens, Pekin, both of Ill.

[73] Assignee: Caterpillar Inc., Peoria, Ill.

[21] Appl. No.: 593,850

[22] Filed: Oct. 5, 1990

[51] Int. Cl.[5] ..... B05C 13/00

[52] U.S. Cl. ..... 118/500; 118/629

[58] Field of Search ..... 118/500, 501, 620, 629, 118/64, 635; 248/176

[56] References Cited

U.S. PATENT DOCUMENTS 2,730,988 1/1956 Starkey ..... 118/635
4,022,933 5/1977 Lee ..... 118/620
4,500,560 2/1985 Gaffrey ..... 118/629
5,006,217 4/1991 Koop ..... 118/620

OTHER PUBLICATIONS

*Materials Engineering*, "Rubbers and Elastomers", Dec. 1989, pp. 178-180, 182.

*Primary Examiner*—Richard V. Fisher
*Assistant Examiner*—Charles K. Friedman
*Attorney, Agent, or Firm*—Robert A. McFall

[57] ABSTRACT

A paint fixture, for supporting a workpiece during the electrostatic application of a spray paint, has an electrically conductive metallic body. The body has a first surface portion that is covered by the workpiece during the electrostatic paint spray application process, and a second surface portion that is covered by a heat resitant, electrically nonconductive material.

3 Claims, 1 Drawing Sheet

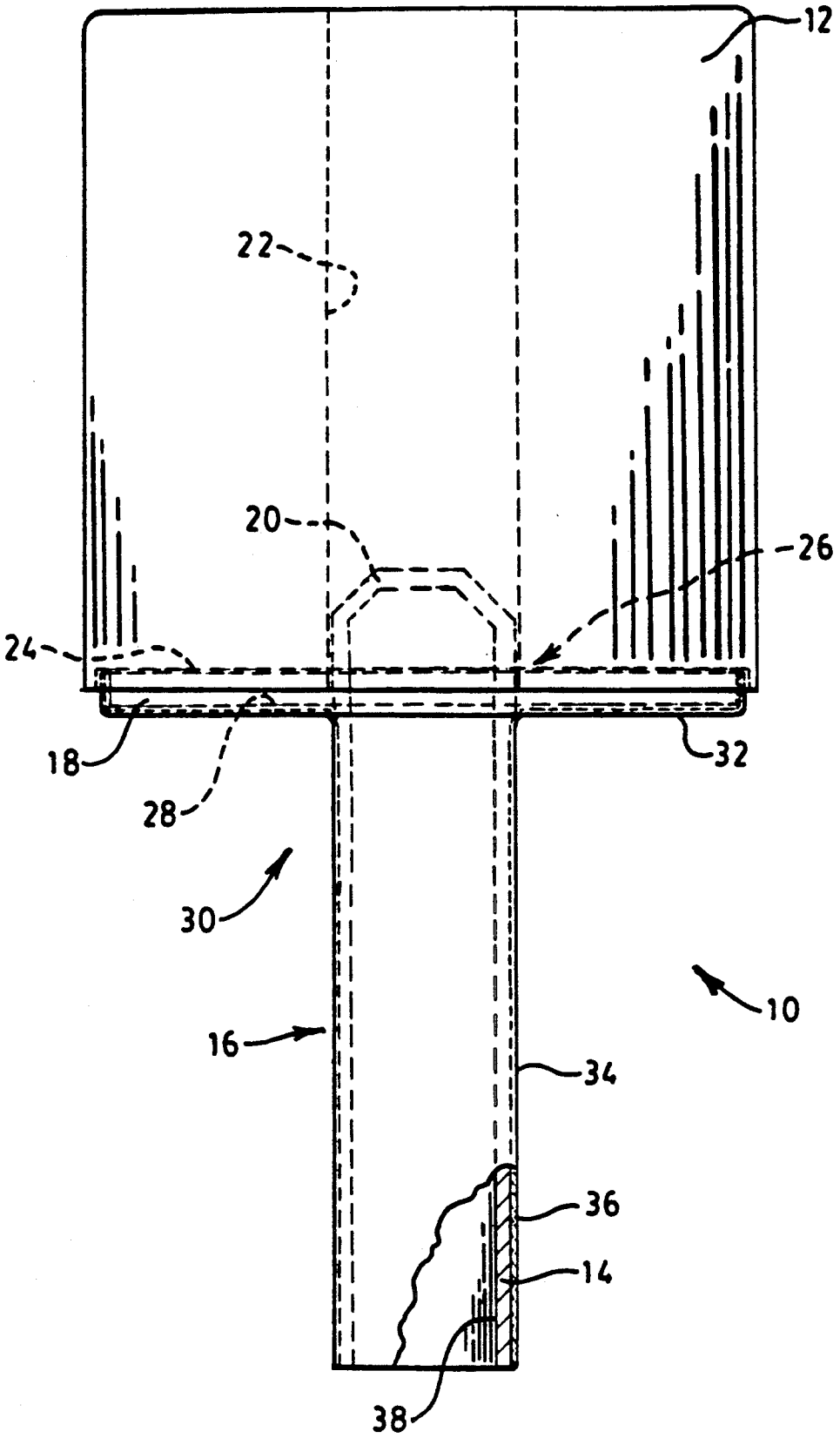
12
22
20
26
24
18
32
28
30
10
16
34
36
14
38

PAINT FIXTURE FOR SUPPORTING ARTICLE DURING ELECTROSTATIC SPRAYING

DESCRIPTION

1. Technical Field

This invention relates generally to a fixture for supporting a workpiece during spray application of a paint, and more particularly to a paint fixture for use in electrostatic painting operations.

2. Background Art

Paint buildup on fixtures that support articles coated by spray application methods has been a long recognized problem. If allowed to accumulate, paint buildup on the supporting fixtures may hinder complete coverage or otherwise interfere with the uniform deposition of a paint coating on the workpiece.

Typically, in electrostatic spray paint processes, the fixture supporting or carrying the workpiece is an element of the electrical circuit connecting the workpiece with a source of electrical charge or ground. In such arrangements, an excess accumulation of coating material on the fixture may prevent the necessary electrical contact between the fixture and the workpiece. Furthermore, if the exposed surfaces of the supporting fixtures have the same electrical charge as the workpiece, the problem of material buildup on the fixtures will be exacerbated.

Heretofore, spray paint deposits on workpiece supporting fixtures have typically been removed mechanically by scraping or wire brushing, chemically by washing or immersion in a solvent, or by a combination of mechanical and chemical operations. These fixture cleaning methods are labor intensive, produce undesirable waste products, and are economically costly.

The present invention is directed to overcoming the problems set forth above. It is desirable to have a fixture for supporting articles during spray painting processes that is easily cleanable by an economically cost effective method. It is also desirable to have such a fixture for use in electrostatic spray painting processes in which the surfaces of the fixture that are exposed to the electrostatic field are electrically nonconductive.

DISCLOSURE OF THE INVENTION

In accordance with one aspect of the present invention, a fixture for supporting a workpiece during spray application of a paint coating to the workpiece in which the spray coating application is carried out in an electrostatic field, has an electrically conductive metallic body. The body of the fixture has a first surface portion that is coverable by the workpiece during application of the paint coating, and a second surface portion that is covered by a heat resistant, electrically nonconductive material.

Other features of the workpiece support fixture include a vitreous coating that is bonded by thermal fusion to the second surface portion of the fixture body.

BRIEF DESCRIPTION OF THE DRAWING

The sole figure is a side view of a paint fixture supporting a workpiece and embodying the present invention.

BEST MODE FOR CARRYING OUT THE INVENTION

In the preferred embodiment of the present invention, a paint fixture 10 supports an automotive type oil filter 12 as it is carried through a paint spray booth in which paint is electrostatically applied to the filter 12. The fixture 10 has an electrically conductive body 14 constructed of a ferrous metal alloy such as low carbon steel.

The filter 12 is connected to an electrical ground through the fixture 10 and a conveyor, not shown, on which the fixture 10 is carried. The electrically conductive body 14 of the fixture 10 comprises a vertically disposed tubular portion 16, and a radially outwardly extending flange 18 attached to the tubular portion 16 near an upper end 20 of the tubular portion. The upper end 20 of the tubular portion 16 has a diameter that is only slightly smaller than the diameter of a centrally disposed oil port 22 of the filter 12. The flange portion 18 has a diameter somewhat smaller than the diameter of the filter 12 to permit a base 24 of the filter to rest upon the flange 18. Further, the base 24 partially overhangs the flange 18 to permit the paint spray to wrap around and coat the rim of the base 24.

During the paint spray process, the base 24 of the filter 12 rests upon the flange 18 and covers a first surface portion 26 of the fixture 10. The first surface portion 26 of the fixture 10 includes the upper end 20 of the tubular portion 16 and an upper surface 28 of the flange 18. During the painting operation, the upper end 20 of the tubular portion 16 engages the central oil port 22 of the filter 12 and maintains the filter on the fixture 10 in centered relationship with respect to the flange 18. Further, the upper surface 28 of the flange 18 is covered by the base 24 of the filter 12 during the painting operation.

As shown in the drawing, a second surface portion 30 of the fixture 10 contiguously joins the first surface portion 26 and includes the external surfaces of the fixture 10 that are exposed to the paint spray during the painting operation, i.e., the external surfaces not covered by the workpiece 12 during the painting operation. In the present embodiment, the second surface portion 30 includes a lower surface 32 of the flange 18 and a radially outer surface 34 of the tubular portion 16 extending below the flange 18.

The second surface portion 30 of the fixture 10 is covered by a heat resistant, electrically nonconductive coating 36. Suitable materials for such a coating include refractory ceramics, glasses, and porcelains. In the preferred embodiment of the present invention, the second surface portion 30 is covered with a vitreous coating 36 that is bonded to the metallic body 14 by thermal fusion. More specifically, the coating 36 is a glass type porcelain enamel applied to the second surface portion 30 by spray deposition to form a coating having a thickness of about 0.25 mm (0.010 in). After initial deposition, the coating 36 is allowed to air dry and is then baked at 760° C. (1400° F.) for 30 minutes to fuse the porcelain enamel to the metal substrate 14. Porcelain enamel coatings typically have a smooth, hard surface, are chemically resistant to most solvents, alkalis and acids, have thermal expansion characteristics adaptable for use on iron, steel and other metallic substrates, a service temperature limit above 425° C. (800° F.), and dielectric strength of about 18,000 v/mm. Porcelain enamel is, therefore, particularly suitable for the coating 36 covering the second body portion 30 of the fixture 10.

The tubular member 16 has an internal bore 38 into which an upwardly extending conveyor mounted pin, not shown, is inserted. The internal bore surface 38 is not coated in order to assure good electrical contact with the conveyor pin.

Industrial Applicability

In typical electrostatic paint processes, an electrostatic charge, having a predetermined polarity and voltage value, is applied to paint particles that are formed by pressure discharge through a nozzle of a spray gun. The workpiece is usually connected to an electrical ground and maintained, during the spray application, at a neutral, or zero, electrical potential. However, in some electrostatic painting processes an electrical charge, having a polarity opposite of that carried by the paint particles, is placed on the workpiece. In both processes, the supporting fixture, or carrier, typically provides the necessary electrical connection with the workpiece.

In the present embodiment, the fixture 10 is carried through the painting zone by a conveyor that is electrically grounded and has a plurality of upwardly extending pins which engage and electrically contact the bore 38 of the tubular portion 16 of the fixture 10. The electrical connection between the workpiece 12 and the fixture 10, and consequently with the conveyor, is provided by the physical contact of the filter oil port 22 and base 24 with the first surface portion 26 of the fixture 10.

Because the coating 36 on the second surface portion 30 of the fixture 10 is electrically nonconductive, the primary electrostatic field established during the painting process is between the source of the spray paint and the workpiece. Consequently, the amount of paint overspray that is deposited on the fixture 10 is less than the amount that would be deposited if the second surface portion 30, like the workpiece 12, carried an electrical charge. Therefore, an important advantage of the paint fixture 10 constructed according to the present invention is that the amount of paint deposited on the exposed surfaces of the fixture is reduced. This characteristic alone reduces the paint buildup problem.

After passing through the spray paint booth, the workpiece 12 is carried into a drying oven where the paint is dried. After drying, the workpiece 12 is removed from the support fixture 10, and the fixture is heated to a temperature of about 343° C. (650° F.) whereupon the paint deposits on the fixture 10 are reduced to a fine ash. Because the surface coating 30 on the fixture 10 has a hard glassy finish, the ash residue does not adhere to the fixture surface. As a result, the ash residue falls onto a collection plate from which it is easily removed. Additional cleaning, such as mechanical brushing, is not required to remove the ash from the fixture surface 30. Therefore, another important advantage of the paint fixture 10 constructed according to the present invention is that paint deposits on the fixture are easily and economically removable by a burnoff operation.

Other aspects, objects and advantages of this invention can be obtained from a study of the drawing, the disclosure, and the appended claims.

We claim:

1. A fixture for supporting a workpiece during spray application of a paint coating to said workpiece, said paint coating application being carried out in an electrostatic field and, subsequent to said paint coating application, paint overspray deposits on said fixture are removed by heating the fixture to a temperature sufficient to thermally decompose the paint overspray deposits, said fixture comprising:

an electrically conductive metallic body having a first surface portion coverable by said workpiece during application of said paint coating to said workpiece and a second surface portion contiguous to said first surface portion, said second surface portion being covered by a vitreous enamel coating having a service temperature limit above 425° C. and a dielectric strength of at least about 18,000 v/mm.

2. A fixture, as set forth in claim 1, wherein said vitreous enamel coating is bonded to said metallic body by fusion at a temperature above 425° C (800° F.).

3. A fixture, as set forth in claim 2, wherein said vitreous enamel coating is a porcelain enamel.

* * * * *